United States Patent [19]

Keller

[11] Patent Number: 4,553,452

[45] Date of Patent: Nov. 19, 1985

[54] METHOD FOR PRODUCING SECURITY KEYS HAVING CLOSURE POSSIBILITIES DIFFERING FROM ONE ANOTHER

[76] Inventor: Ernst Keller, Untere Schwandenstr. 22, CH-8805 Richterswil, Switzerland

[21] Appl. No.: 550,115

[22] Filed: Nov. 9, 1983

[51] Int. Cl.[4] ..... B21K 13/00

[52] U.S. Cl. ..... 76/110; 70/411

[58] Field of Search ..... 76/110; 70/409, 411, 70/358

[56] References Cited

U.S. PATENT DOCUMENTS

| | | | |
|---|---|---|---|
| 3,777,520 | 12/1973 | Grepinsek | 70/409 |
| 3,788,110 | 1/1974 | Sugae . | |
| 3,824,818 | 7/1974 | Neale | 70/358 |
| 4,325,241 | 4/1982 | Keller | 70/409 |

FOREIGN PATENT DOCUMENTS

| | | | |
|---|---|---|---|
| 1553388 | 9/1973 | Fed. Rep. of Germany . | |
| 2606557 | 8/1977 | Fed. Rep. of Germany . | |
| 3021334 | 12/1981 | Fed. Rep. of Germany . | |
| 1038997 | 8/1966 | United Kingdom | 70/411 |

*Primary Examiner*—Roscoe V. Parker

*Attorney, Agent, or Firm*—Browdy and Neimark

[57] ABSTRACT

For producing security keys, in a first method step bore patterns differing from one another are produced, each bore pattern having the same number of bore locations. The corresponding bores are standard bores, which however may vary in terms of their bore depth. In a second method step, a prespecified number of selected bore locations in each bore pattern is varied in terms of their positions. In a third method step, each selected bore locations is additionally varied in terms of a prespecified number of bore shapes differing from one another.

4 Claims, 7 Drawing Figures

METHOD FOR PRODUCING SECURITY KEYS HAVING CLOSURE POSSIBILITIES DIFFERING FROM ONE ANOTHER

FIELD OF THE INVENTION

The present invention relates generally to a method for producing security keys having closure possibilities differing from one another. In the locks associated with such keys, spring-loaded pin tumblers supported in radial bores can be displaced, in order to permit rotation of the cylinder plug, by the insertion of a security key which effects the correctly displaced positions of the rows of pin tumblers by means of bores disposed in the key. At least one of the bores of the key has two or more different shapes to match the head of the associated pin tumbler.

BACKGROUND OF THE INVENTION

A great number of security keys, having various profiles, are known. The purpose of the profiling of these keys is to improve security against unauthorized methods of opening and to increase the possible number of closures while retaining the same key length. The enormous quantity of key profiles and corresponding locks makes both the manufacturing process and the control of access to keys and locks extraordinarily uneconomical. This is exacerbated by the great number of cylinder components in a cylinder sequence. A further disadvantage of known key profiles is the limited number of different closures attainable with them, which means that with some key shapes various cylinders can be unlocked.

SUMMARY OF THE INVENTION

It is accordingly a principal object of the present invention to create a method which enables the production of security keys with a great number of different closure possibilities at a favorable cost.

A further object of the invention is to create a method permitting economical production of security keys with the aid of a computer.

It is also an object of the invention to create a method for producing security keys in which the associated cylinder plugs have the same key path cross section.

These objects are attained with a method in which different patterns of bores are produced on the keys, each pattern having the same number of bore locations, a given number of which are varied in terms of a number of different bore shapes. Advantageous developments of this method are also disclosed.

The method according to the invention enables considerable savings in terms of inventories of keys and rotors and also makes it possible to shorten the procurement time for replacement components greatly. It is also possible to dispense with broaching tools for profiling the rotors and profile milling cutters for manufacturing the keys.

An exemplary embodiment of the invention is described in further detail below, referring to the drawings.

DESCRIPTION OF THE PREFERRED EMBODIMENT

Figure 1:
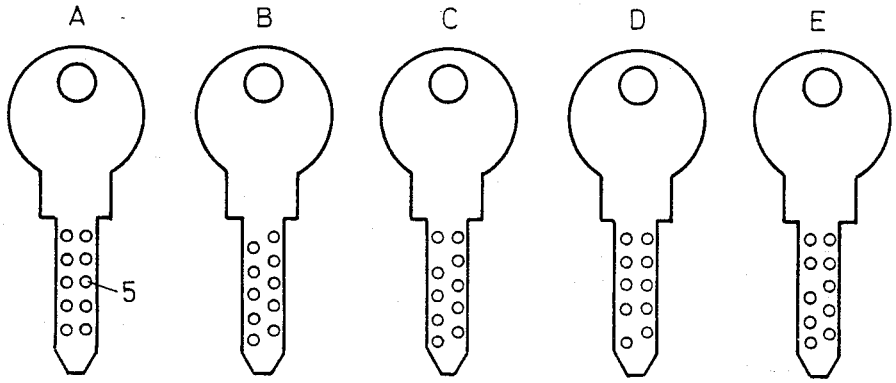
FIG. 1 is a schematic illustration of five keys, fabricated in accordance with differing bore patterns.

FIG. 1, in terms of the schematically illustrated keys A–E, shows five different bore patterns, each having ten bores 5, which are disposed laterally in two rows. These bores 5 are standard bores; however, they may be different in terms of the bore depths. Additionally, it is possible for edgewise bores, not shown, to be provided. The term "bore pattern" is understood to mean a disposition of bores on a key. Naturally, a bore pattern must match the positions of the pin tumblers in the cylinder. The positions of the bore locations of a bore pattern are ascertained in a manner known per se, with the use of a computer being advantageous. After different bore patterns have been produced, a suitable number at least 1 of particularly selected bore locations 14 and 15 are selected, and these are varied in each bore pattern in terms of their position.

Figure 2:
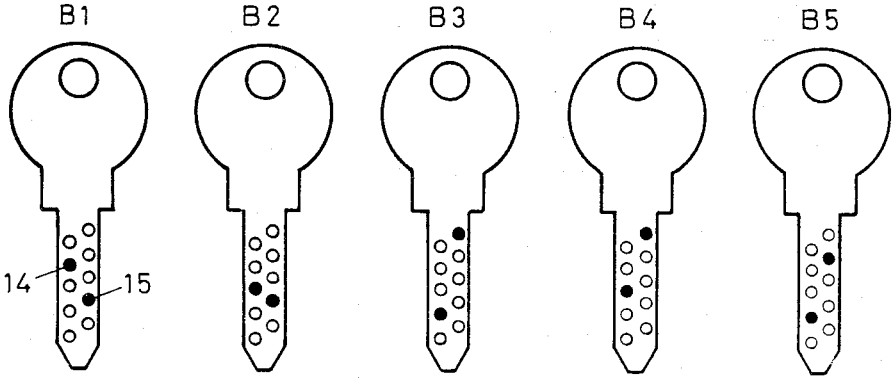
FIG. 2 is a schematic illustration of five keys, each having two particularly selected bore locations.

FIG. 2 shows five variations of two selected bore locations 14 and 15, which were all varied in the bore pattern B of FIG. 1. In addition to the five arrangements B1–B5, however, many other arrangements are also possible. Each selected bore location 14 and 15 is now additionally varied in terms of its bore shape. Examples of possible shapes that may be selected are the different stepped bores a–k, ten of which are shown in FIGS. *6a* and *6b*.

Figure 3:
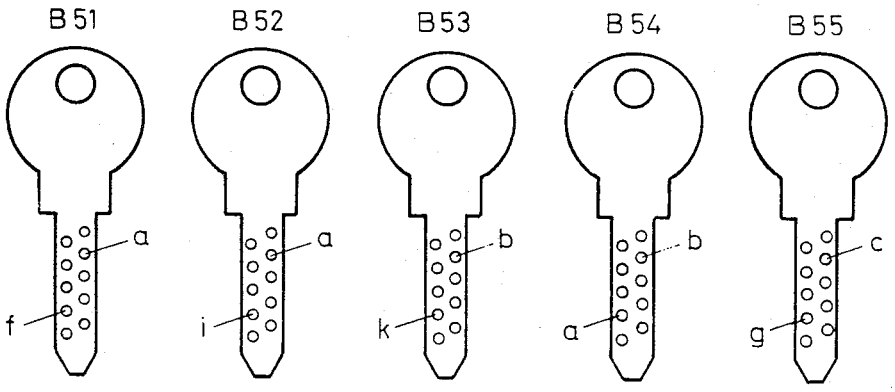
FIG. 3 is a schematic illustration of five keys, in which the selected bore locations are additionally varied in terms of their shape.

FIG. 3 schematically shows five variations B51–B55 of bore shapes in terms of the pattern B5 of FIG. 2, and referring also to FIGS. *6a* and *6b*. Here again, the possible number of profiles is far greater than five. With the example chosen here, having ten bore locations, two selected bore locations and ten bore shapes, it is possible to produce 162,000 profile variations and accordingly the same number of keys having closure possibilities differing from one another.

Figure 4:
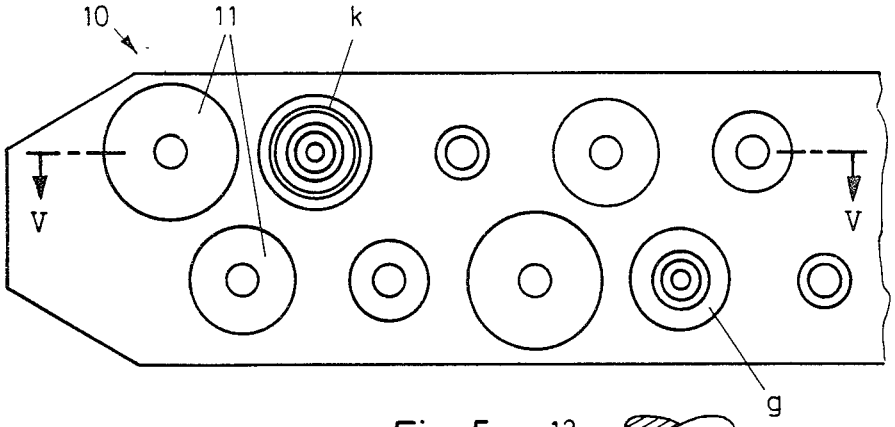
FIG. 4 is a view of the shaft of a key having bores.
Figure 5:
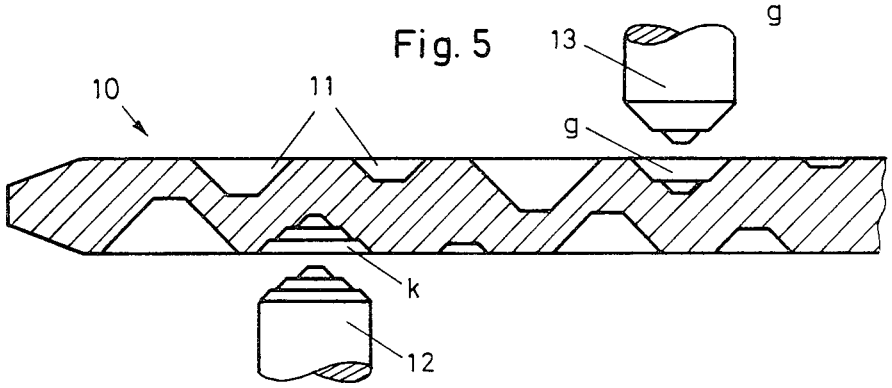
FIG. 5 is a longitudinal section through a shaft of a key as well as two pin tumblers; and FIGS. *6a, 6b* show cross-sectional profiles of stepped bores.
Figure 6A:
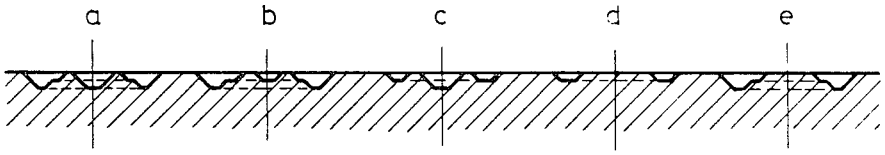
Figure 6B:
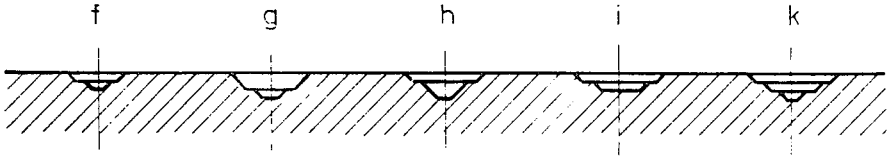

In FIGS. 4 and 5, a shaft 10 produced in accordance with the invention of a key is shown, with eight standard bores 11 and two stepped bores g and k; the associated tips 12 and 13 of pin tumblers are also shown.

FIGS. *6a* and *6b* shows ten cross-sectional profiles a–k of differing stepped bores.

The security key according to the invention may be embodied either as a normal key or as a reversible key, and it may have a flat or rhomboid profile.

It will be understood that the foregoing text and drawing relate to an embodiment of the invention given by way of example but not limitation, various other embodiments and variants being possible within the spirit and scope of the invention.

What is claimed is:

1. A method for producing a plurality of security keys having closure possibilities differing from one another, wherein spring-loaded pin tumblers supported in radially extending bores in the cylinder of a lock, said cylinder including a cylinder plug having a key path are displaceable by means of a security key to permit rotation of the cylinder plug, the security key being insertable into the key path of the cylinder plug and capable, by means of bores, of effecting a correctly displaced position of the rows of pin tumblers, wherein at least one of the bores has two or more different shapes for the head of an associated pin tumbler, comprising:

producing different bore patterns in said plurality of keys, each bore pattern having the same number of bore locations, the positional arrangement of said bore hole locations being different in each of said patterns;

selecting, in each bore pattern, a prespecified number of bore hole locations, said prespecified number being at least 1;

varying the position within said bore hole pattern of said preselected number of bore hole locations;

additionally varying at each specified bore location, a prespecified number of bore shapes differing from one another, said prespecified number being at least 1.

2. A method as defined by claim 1, wherein said bore shapes differing from one another are stepped.

3. A method as defined by claim 1, wherein said security key is a reversible key.

4. A method as defined by claim 2, wherein said security key is a reversible key.

* * * * *